United States Patent [19]

Lee et al.

[11] Patent Number: 4,938,473

[45] Date of Patent: Jul. 3, 1990

[54] TREADMILL WITH TRAMPOLINE-LIKE SURFACE

[76] Inventors: R. Clayton Lee, 10369 Briar Forest, Houston, Tex. 77042; Jeffrey O. Meredith, 10818 Sagetrail Dr., Houston, Tex. 77089

[21] Appl. No.: 172,412

[22] Filed: Mar. 24, 1988

[51] Int. Cl.[5] ..... A63B 23/06

[52] U.S. Cl. ..... 272/69; 272/65

[58] Field of Search ..... 272/69, 65, 70, 97

[56] References Cited

U.S. PATENT DOCUMENTS

| | | | |
|---|---|---|---|
| 3,689,066 | 9/1972 | Hagen | 272/69 |
| 4,204,673 | 5/1980 | Speer, Sr. | 272/69 |
| 4,350,336 | 9/1982 | Hanford | 272/69 |
| 4,426,075 | 1/1984 | Otte | 272/69 |
| 4,452,444 | 6/1984 | Schulze, Jr. | 272/65 |
| 4,548,405 | 10/1985 | Lee et al. | 272/69 |
| 4,569,515 | 2/1986 | Gordon | 272/65 |
| 4,708,338 | 11/1987 | Potts | 272/69 X |
| 4,726,581 | 2/1988 | Chang | 272/69 X |
| 4,776,581 | 10/1988 | Shepherdson | 272/65 |

FOREIGN PATENT DOCUMENTS

| | | | |
|---|---|---|---|
| 196877 | 10/1986 | European Pat. Off. | 272/69 |
| 210400 | of 1909 | Fed. Rep. of Germany | 272/65 |

*Primary Examiner*—Robert W. Bahr

*Attorney, Agent, or Firm*—Pravel, Gambrell, Hewitt, Kimball & Krieger

[57] ABSTRACT

A treadmill with a trampoline-like surface provides a peripheral support which tensions the belt in both longitudinal and lateral directions using pairs of angularly oriented springs each pair extending from a roller bracket at an angle, of, e.g., forty-five degrees (45°) to the lateral edge of the mat, connecting thereto at spaced apart positions. The spring support tensions the belt with both longitudinal and lateral (or transverse) load components.

2 Claims, 6 Drawing Sheets

TREADMILL WITH TRAMPOLINE-LIKE SURFACE

BACKGROUND OF THE INVENTION:

1. Field of the Invention:

This invention relates to treadmills and, more particularly, to an improved treadmill apparatus which is formed with a trampoline-like surface, supported by an improved multiple position peripheral spring support, that is resilient enough to minimize shock when the foot of an exerciser engages the treadmill surface but rigid enough not to interfere with the normal walking, jogging or running motions.

Treadmills utilize an endless moving belt that allows an individual to walk, jog or run in place. Treadmills are useful not only for exercise purposes, but for rehabilitation programs and medical testing such as the popular "stress test." There is also a demand for treadmills in indoor health clubs since many clubs are not able to build a running track and such a treadmill provides the capability of a well rounded exercise program.

Treadmills traditionally are formed with a thin endless belt which travels over a supporting surface such as a metal plate so that the belt can withstand the weight of the individual using it. The belt in such a design has a tendency to wear because of the frictional contact between the plate and belt. The metal support plate forms a rigid surface that can create various injuries such as "stone bruise" or "shin splints" because of its hard, unyielding surface. Another possible way of supporting the belt is to provide rollers under the belt. This construction is not totally desirable because the rollers provide an uneven exercise surface.

Thus, exercising on a treadmill with a rigid support surface underneath the belt is similar to exercising on a hard surface because the impact of the feet of the exerciser and the support surface for each step which is taken. This tends to exert undue strain on the legs, which is a common cause of leg problems for joggers and runners and is particularly bothersome for patients who are undergoing a rehabilitation program.

Several treadmill devices are the subject of U.S. Patents. The Jones U.S. Pat. No. 2,315,485, issued Apr. 6, 1943, entitled "Exercising Device," shows an exercising machine having a moving belt, end rollers supporting the belt at its end portions, and an adjustment for varying the tension of the belt.

The Volk U.S. Pat. No. 921,755, issued May 18, 1909, illustrates a treadmill-type device constructed of cross slats, each carrying anti-friction rollers. Other treadmill devices including the Haracz U.S. Pat. No. 3,628,654, entitled "Vacuum Belt Conveyor;" the Hagan U.S. Pat. No. 3,689,066, entitled "Treadmill Exercising Device With Yieldable Belt Support;" and German Patent No. 2,503,118, entitled "Movable Endless Band Apparatus For Physical Training, Containing Profiled Rails Connected To Band."

Applicants are the owners of prior U.S. Pat. No. 4,548,405, issued Oct. 22, 1985, entitled "Treadmill With Trampoline-Like Surface," which discloses a treadmill having a belt surface supported at its lateral edges with springs and between front and rear rollers.

The present invention provides an improvement to these above-referenced patents in that an improved spring geometry supports the lateral edges of the belt in both lateral and longitudinal directions by means of a pair of spaced apart angularly extending springs which contact the belt at spaced positions. Further, Applicants' invention provides an improved treadmill apparatus which may utilize a secondary surface, spaced below the belt upper surface, that limits the vertical deflection of the belt during use. The secondary surface maintains stability of the belt when it is used by very heavy persons or by runners that exercise vigorously.

SUMMARY OF THE INVENTION:

A treadmill has been developed in accordance with the invention which provides an improved vertically deflecting surface that is designed to eliminate the need for any rigid reinforcing surfaces directly underneath the belt. The supporting belt surface is resilient enough to absorb shock so that people can walk, jog or run with less strain on their legs and at the same time rigid enough to provide a stable exercising surface.

The treadmill which embodies the invention includes an endless belt, the uppermost side of which is adapted to form a flat surface capable of supporting an individual. An improved lateral support extends along the edge of the endless belt defining the belt shape while supporting the endless belt continuously. The belt is supported with spring assemblies by a pair of continuous rails that are spaced from and extend along the lateral edges of the endless belt. Curved sections of the rail define the curved end portions of the belt in one embodiment. The edges of the belt are connected to their respective rails through a plurality of pairs of coil springs, each pair carried by a roller bracket and each pair connected at spaced apart positions to the belt. The roller brackets rotatably engage the rail and travel thereon. In the preferred embodiment, the roller bracket assemblies slidably engage each rail and are faced toward the edge of the belt, and the roller brackets are connected at spaced apart positions along the belt, each bracket carrying a pair of springs which extend from the bracket at angles with respect to each other so that the springs attach to spaced apart positions along the edge of the belt. This improved spring arrangement provides both longitudinal and lateral load carrying to the edge of the belt for increased longitudinal and lateral stability. This improved spring arrangement provides both longitudinal and lateral support to the roller brackets for the maintenance of their alignment with the rails they engage.

In the preferred embodiment, the treadmill includes a peripheral support which is spaced from and extends substantially along the sides of the endless belt and includes curved supporting portions at each end of, and on both sides of the endless belt. In this embodiment, two extra rollers are attached to each roller bracket mounted inside the support railing and with their axis at 90° to the load bearing roller in each bracket. These extra rollers engage the curved supporting portions at each end to maintain the alignment of the load bearing roller with the support rail without the continuous support rollers shown at each end of the endless belt in previous embodiments. The springs are arranged in pairs and are angularly positioned with respect to each other for applying tension to the belt in both lateral and longitudinal directions at each position where a respective pair of springs attaches the endless belt. Preferably two springs extend from each roller bracket at an acute angle of forty-five degrees (45°), for example, with respect to the longitudinal axis of the belt. In this manner, a longitudinal and a lateral load component tension the belt at each spring.

In the preferred embodiment, the apparatus includes at least one drive roller so that the belt is driven through frictional contact between the inner surface of the belt and the drive roller.

In the preferred embodiment, the drive roller is mounted upon a rotating shaft. The shaft can carry a pair of spaced apart wheels on the opposite respective side portions of the drive roller for supporting the belt at its periphery.

In one embodiment of the apparatus of the present invention, a secondary surface is positioned under the belt for limiting vertical deflection of the belt during use such as for limiting the amount of downward movement of the belt when it is used by heavier persons.

In another embodiment of the apparatus of the present invention, the belt is segmented, comprising a plurality of belt sections, each of the sections being connected by tensile members, such as for example, coil springs or an elastomeric member for forming a tensile load transfer between the edges of adjacent belt sections.

BRIEF DESCRIPTION OF THE DRAWINGS:

For a further understanding of the nature, objects, and advantages of the present invention, reference should be had to the following detailed description, taken in conjunction with the accompanying drawings, in which like reference numerals denote like elements, and wherein.

Figure 2:
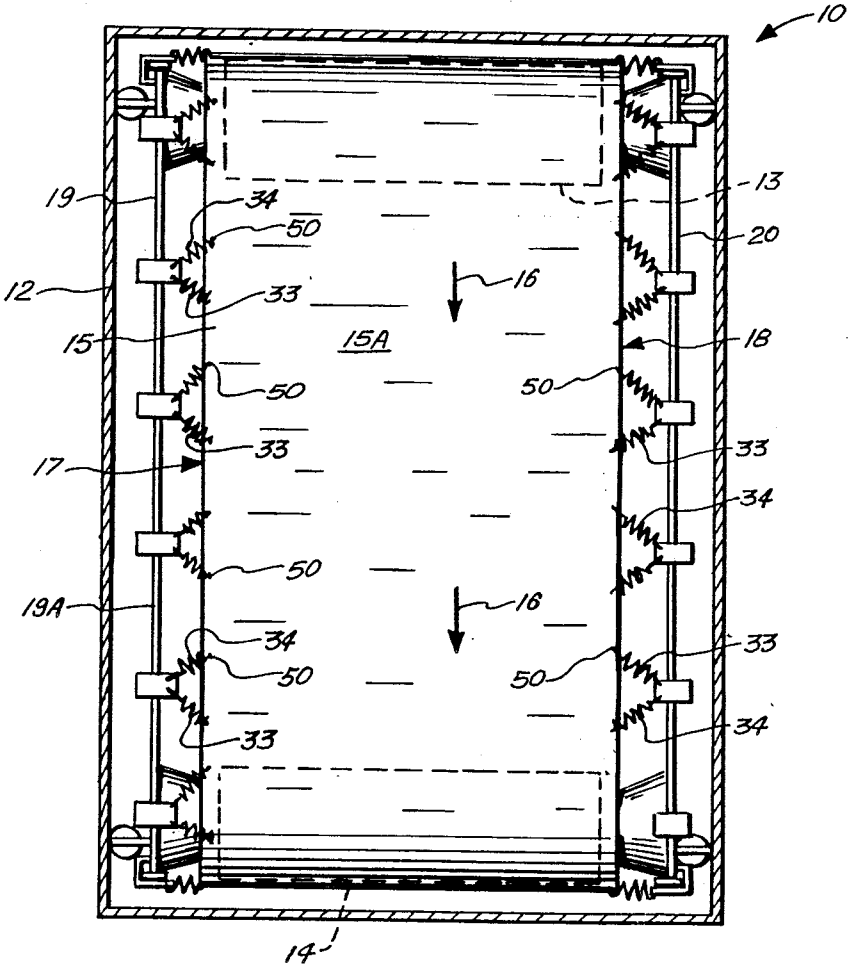
FIG. 2 is a top view of the preferred embodiment of the apparatus of the present invention.
Figure 1:
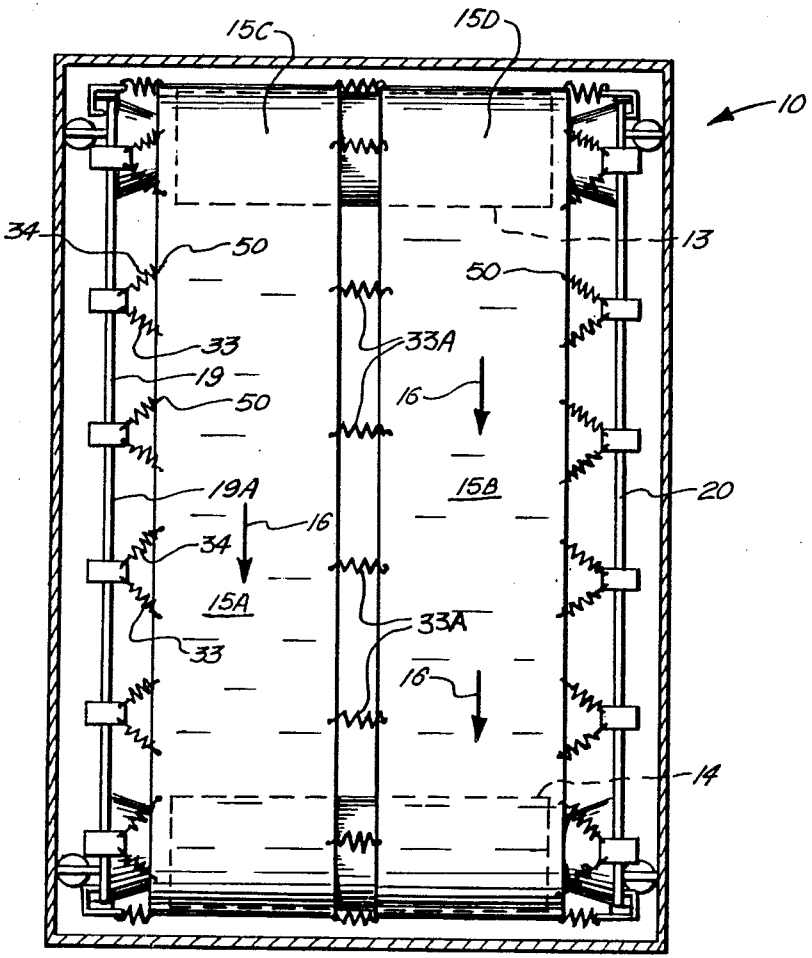
FIG. 1 is a top view of one embodiment of the apparatus of the present invention.

DETAILED DESCRIPTION OF THE PREFERRED EMBODIMENT:

FIGS. 1 and 2 show generally the preferred embodiment of the apparatus of the present invention designated generally by the numeral 10. In FIG. 1, there can be seen a plan view of the treadmill apparatus 10 of the present invention having a frame 12 supporting a pair of roller assemblies 13, 14 (phantom lines).

An endless belt 15 is supported so that a runner, jogger or walker can stand upon the belt surface 15A. As the belt moves in the direction shown by the Arrows 16 in FIG. 1, the runner, walker or jogger can move his or herself through a typical jogging, walking, running gait yet remain in the same position as is typical with all treadmills. However, with the present invention, a cushioned trampoline-like surface 15A is provided because the peripheral edge portions 17, 18 of the belt 15 are supported by a plurality of spring assemblies, as will be described more fully hereinafter. The belt can be made of a woven plastic, for example, or like material, such as is commonly used in the manufacture of trampoline surfaces. Alternately, a laminated belt can be used having two layers of woven plastic with a foam layer therebetween.

Figure 4:
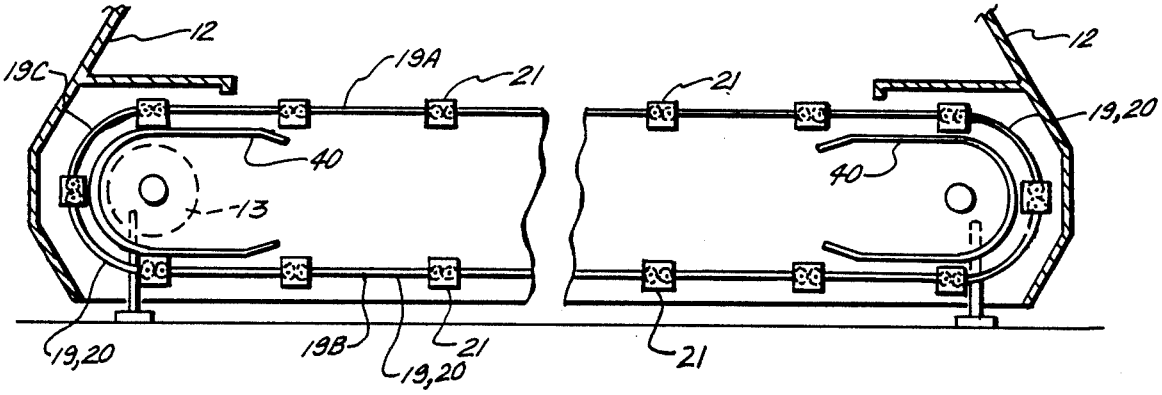
FIG. 4 is a partial sectional elevational view of the preferred embodiment of the apparatus of the present invention.
Figure 6:
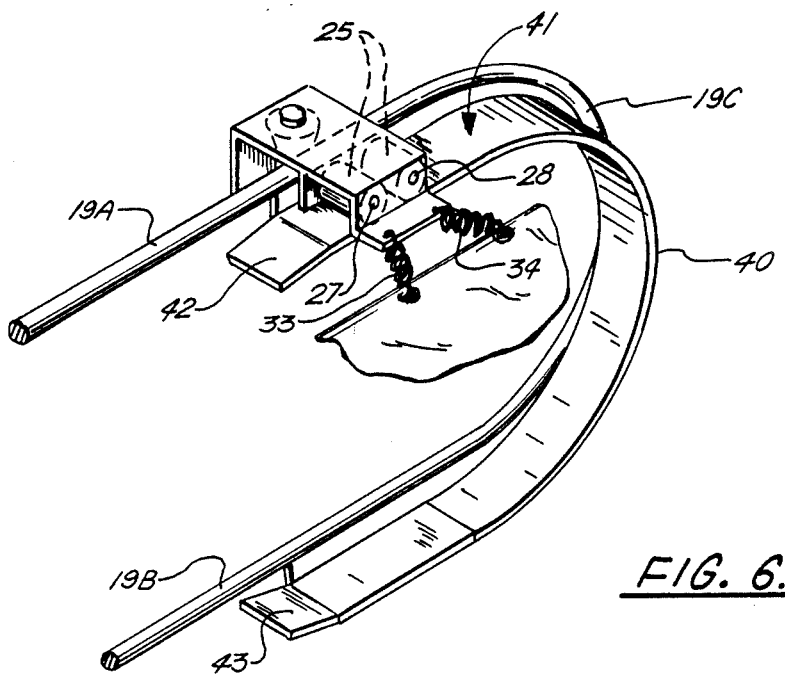
FIG. 6 is a fragmentary perspective view of the preferred embodiment of the apparatus of the present invention illustrating the roller bracket assembly.

A pair of continuous rails 19, 20 are provided on opposite edge portions of the belt 15 and spaced laterally therefrom, as shown in FIGS. 1 and 2. The rails include a top 19A and a bottom 19B rail portion as well as a semicircular 19C end portion both fore and aft, as shown in FIGS. 4 and 6. Rail 10 would be similarly shaped.

Figure 5:
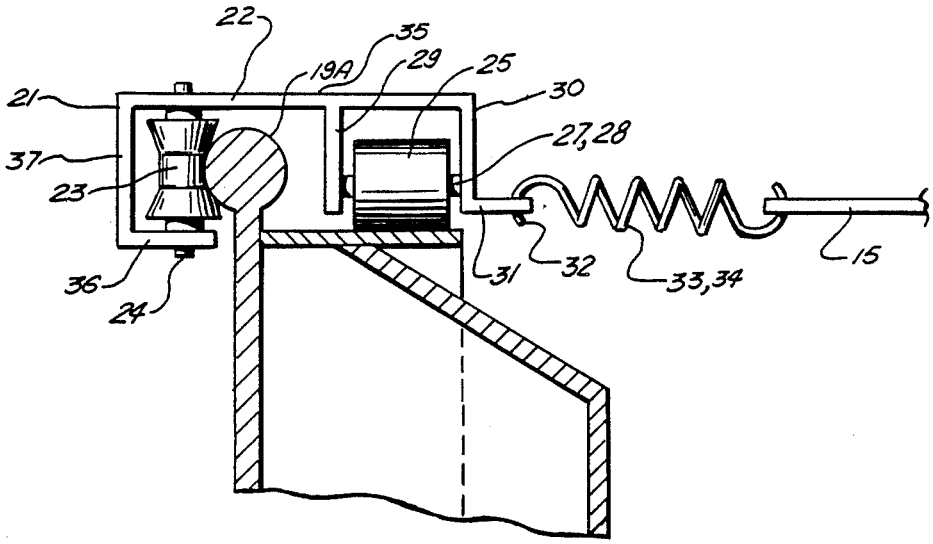
FIG. 5 is an elevational fragmentary view of the preferred embodiment of the apparatus of the present invention illustrating the roller bracket assemblies.

Each rail 19, 20 has a plurality of roller brackets 21 mounted thereon for travel (see FIGS. 5 and 6). Each roller bracket includes a bracket frame portion 22 made of suitable structural material such as stainless steel or the like. Bracket 21 supports a plurality of rollers including vertical roller 23 mounted upon vertical shaft 24 and horizontal roller 25. In the preferred embodiment, a pair of horizontal rollers 25, 26 are shown. Each horizontal roller 25, 26 is mounted upon a corresponding horizontal shaft 27, 28. The bracket includes a structural section, as shown in FIG. 5, having vertical portions 29, 30 for supporting shafts 27, 28 and innermost, inwardly facing horizontal flange portion 31 having at least one opening 32 therein receptive of coil springs 33, 34. Bracket 22 is further comprised of an uppermost flat horizontal portion 35, lowermost horizontal portion 36 which extend outwardly of rails 19, 20 and vertical flange 37.

At its end 19C, 20C portions, rails 19, 20 include a flat semicircular portion, designated in FIG. 6 by the numeral 40. Flat rail section 40 provides a flat outer curved surface 41 which has a curvature similar to that of rail section 19C, as shown in FIG. 6. The flat surface 41 is adapted to receive horizontal rollers 25 thereupon so that the flat rollers engage and travel upon surface 41. The terminal ends of flat rail section 40 include beveled portions 42, 43, as shown in FIG. 6, which help register rollers 25 upon surface 41.

Springs 33, 34 attach to roller bracket 21 at horizontal flange 31. Springs 33, 34 attach at two spaced apart different positions to mat 15, and more specifically to the peripheral edge 17, 18 portions thereof. Notice in FIGS. 1 and 2 that each roller bracket 21 carries a pair of springs 33, 34, each attaching at a grommet opening, for example, in spaced apart positions, designated by the numeral 50 in FIGS. 1 and 2. This arrangement places each spring 33, 34 at an acute angle with respect to mat edges 17, 18 of, for example, forty-five degrees (45°) and thus allows each spring to impart both longitudinal and lateral tension to the mat 15 at its edge 17, 18 portions.

Figure 3:
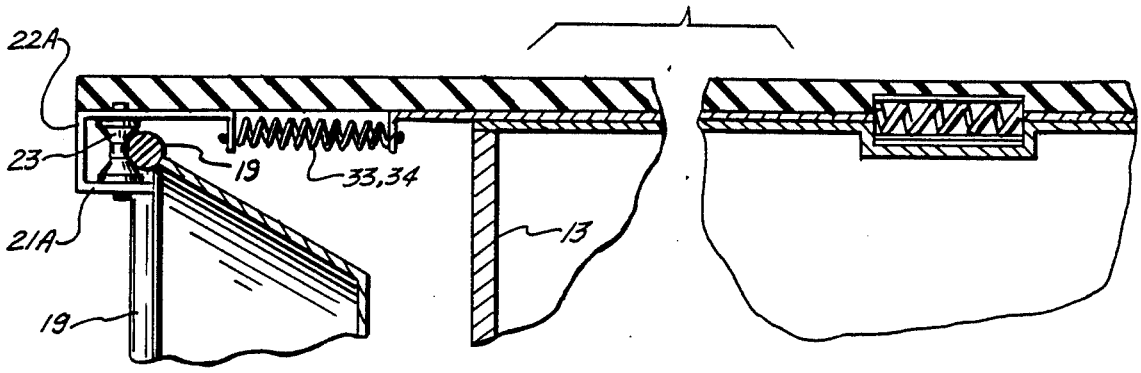
FIG. 3 is a partial sectional view of one embodiment of the apparatus of the present invention.
Figure 3A:
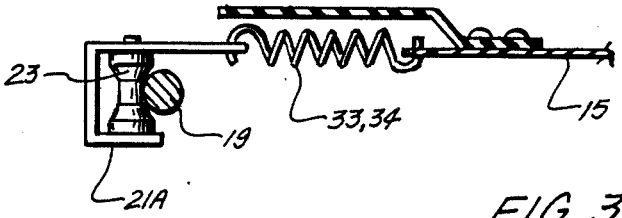
FIG. 3A is a partial sectional fragmentary view of the preferred embodiment of the apparatus of the present invention.

In one embodiment (FIG. 1), the mat 15 can be in the form of pair of spaced apart mats 15C, 15D, each having an upper surface 15A, 15B adapted to receive the foot of a runner, walker or a jogger during exercise sessions. Springs 33A join the mats 15C, 15D together. One skilled in the art will see that the use of rollers 13, 14 is optional because support to the peripheral edges 17, 18 of mat 15 is provided by roller assemblies 21 and by the coil springs 33, 34, as above-described even at end portions 19C, 20C of the rails 19, 20. Rollers 13, 14 can be driven and powered to rotate, for example, electrically if desired. In FIGS. 3–3A, roller bracket 21A does not have horizontal rollers 25. The bracket 21A can be used where end rollers 13, 14 are used to support the ends of the mat 15 instead of flat rail section 40.

Figure 7:
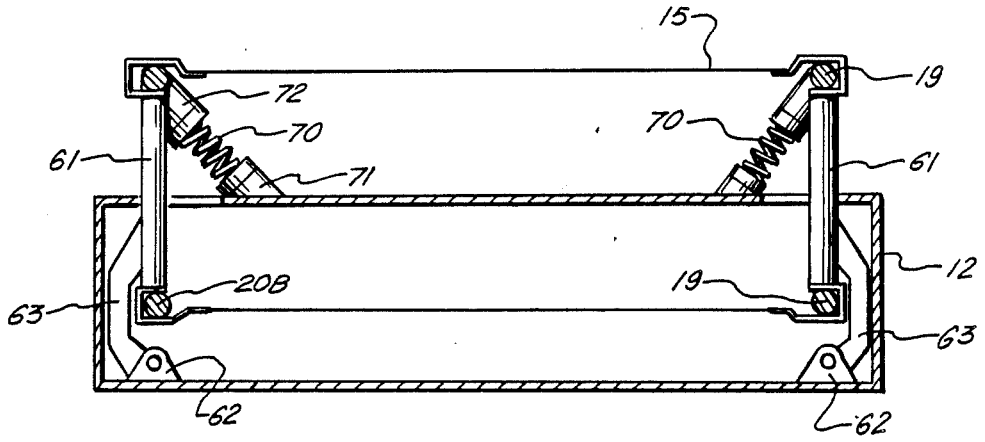
FIG. 7 is a sectional elevational view of another embodiment of the apparatus of the present invention.
Figure 8:
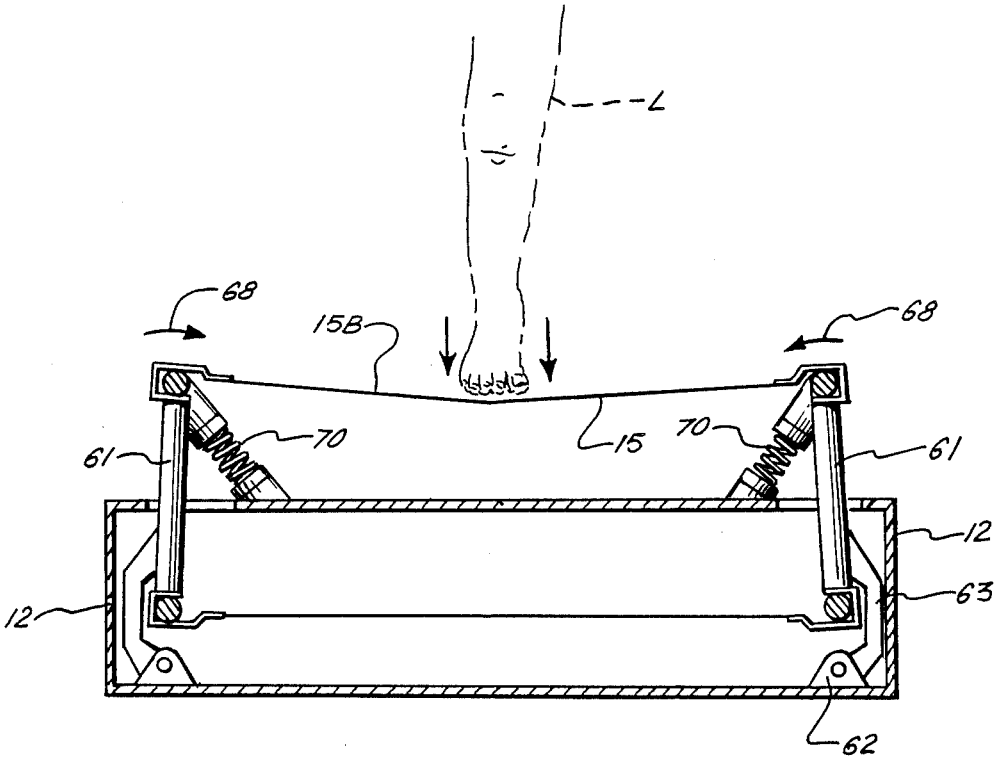
FIG. 8 is a sectional elevational view of another embodiment of the apparatus of the present invention shown during use.

In the embodiment of FIGS. 7 and 8, the mat edges 17, 18 are supported by shock assemblies 60, each including an upstanding articulating link 61 which can pivot inwardly upon pivot support 62. A gusset member 63 extends around the bottom of rail section 20B. A shock absorber 70 in the form of a coil spring supported at its ends by spring socket 71, 72 supports the rail sections 19, 20 while the size and constant of the spring 70 determine the degree of flexibility of the mat inwardly, as indicated by the curved Arrows 68 in FIG. 8, when the leg L of a runner or walker presses against the upper surface 15B of the mat 15.

Figure 9:
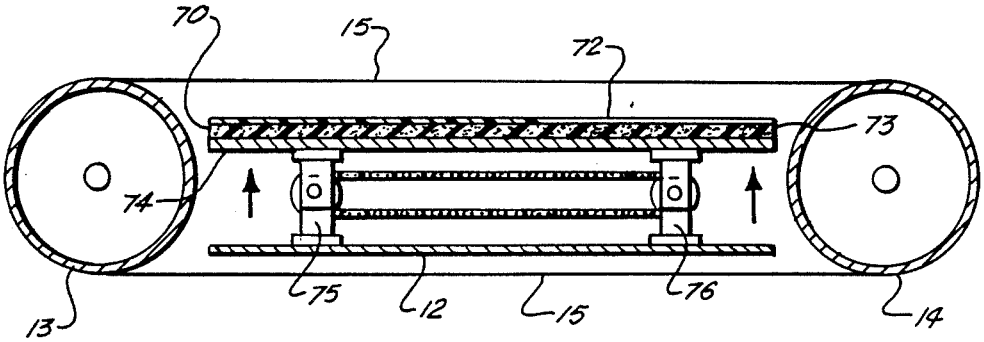
FIG. 9 is a sectional elevational view of the preferred embodiment of the apparatus of the present invention illustrating the secondary support surface portion thereof.
Figure 10:
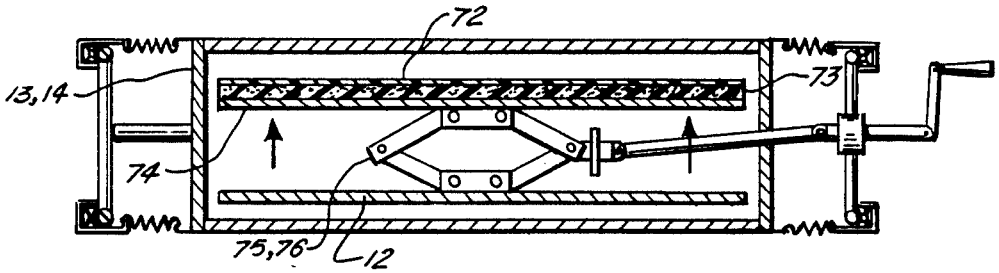
FIG. 10 is a sectional elevational view of the preferred embodiment of the apparatus of the present invention illustrating the secondary support surface.
Figure 11:
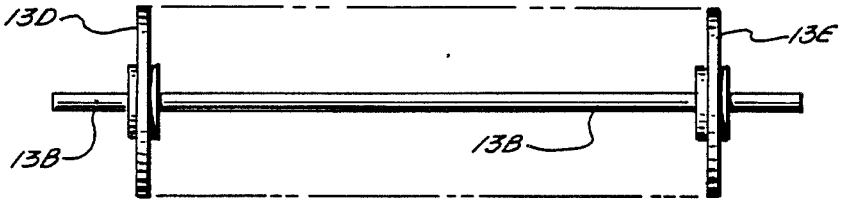
FIG. 11 is a partial fragmentary view illustrating the drive shaft and side wheel portions of the drive roller assembly.
Figure 12:
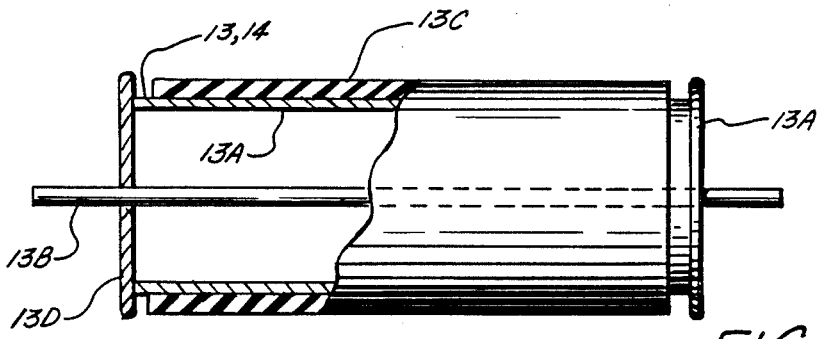
FIG. 12 is another fragmentary view of the drive roller assembly illustrating the side wheels, the drive roller and the foam cover.

In the embodiments of FIGS. 9–10, a secondary surface 70 is provided which includes an upper frictionless surface 72, a middle cushioning surface of foam, for example, 73, and a lower structural surface of metal, wood or the like, designated by the numeral 74. The mats 15C, 15D could be connected by springs 33A covered by a cylindrical hose-like sleeve 33B. A pair of jack assemblies 75, 76 supported by frame 12 can be used to raise or lower the secondary surface 70 to limit the degree of vertical deflection of mat 15 downwardly. FIGS. 11, 12 illustrate more particularly the construction of rollers 13, 14 as including a cylinder 13A, a drive shaft 13B, and an outer foam or other resilient surface 13C. End rollers 13D, 13E can extend upwardly and register with the mat 15 at its edge surfaces 17, 18.

FIGS. 13–16 illustrate an improved hand rail construction for use with the apparatus of the present invention. Frame 12 includes a forward upstanding pedestal 80 having a pair of spaced apart hand rails 81, 82 which attached to pedestal 80 using rotary bearings 83, 84. Each hand rail 81, 82 includes a bottom rail 85, a top rail 86, and a connecting rail 87 that defines a handle typically gripped by the user (see FIG. 16). The angle A between lower rail 85 and handle 87 is preferably between 15° and 45°, that angle being designated by the letter "A" in FIG. 16. Handle 17 can carry a switch plate 88 having a plurality of switches thereon for operating treadmill 10, for example, an on/off switch 89, a speed switch 90, and an elevation switch 91 for controlling the angle of inclination of the treadmill 10. A forward caster 92 would typically extend and retract to raise and lower the forward end portion of frame 12 thus varying the angle of inclination of the running surface defined by belt 15.

An instrument panel 93 is mounted upon cross bar 94 which connects handles 81, 82. Instrument panel 93 would include a graphics display of any number of desirable parameters, such as distance, time, pace (such as minutes per mile), or the like.

Figure 13:
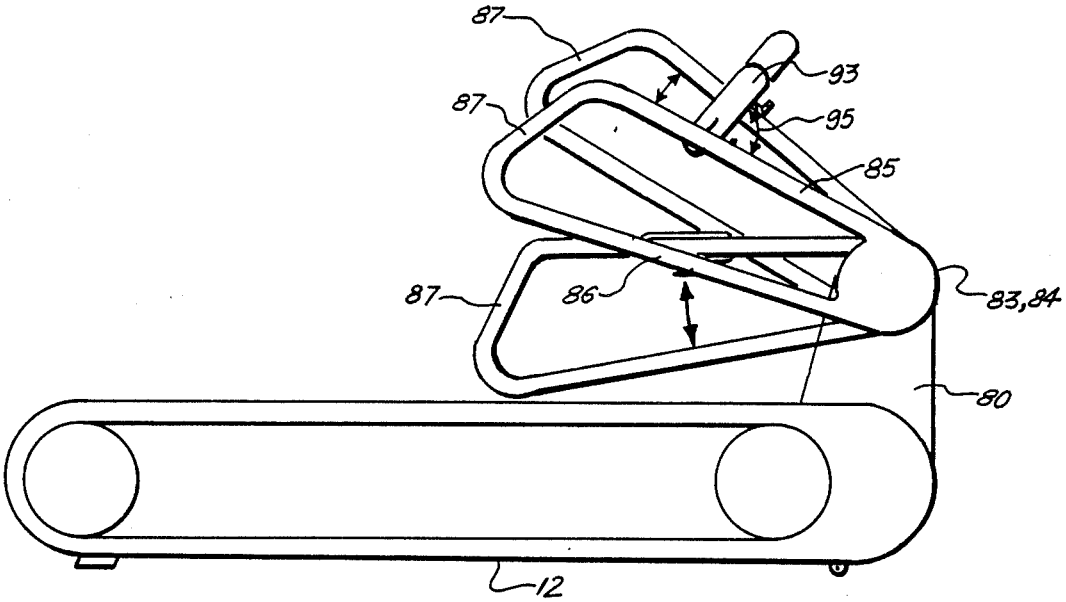
FIG. 13 is an elevational view of one embodiment of the apparatus of the present invention illustrating the improved hand rail construction.
Figure 14:
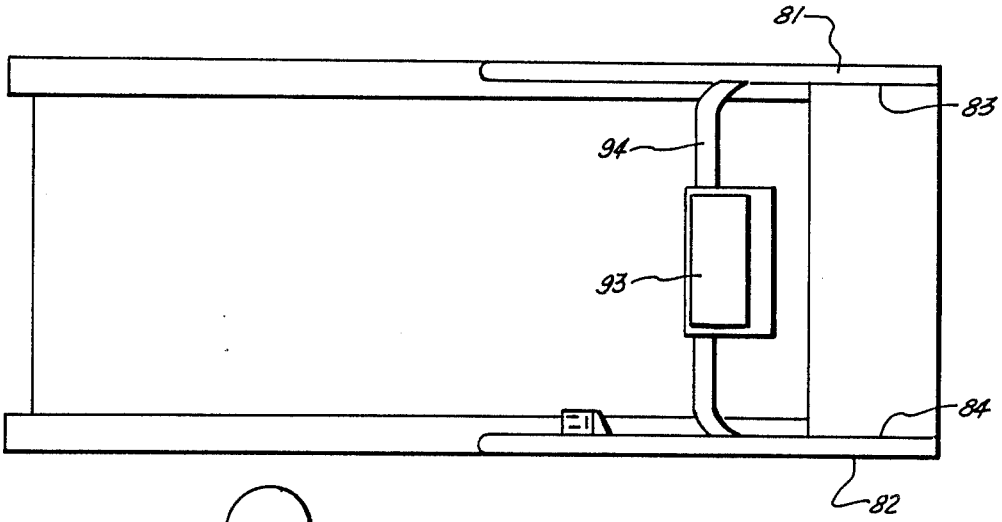
FIG. 14 is a plan top view of the embodiment of FIG. 13.
Figure 15:
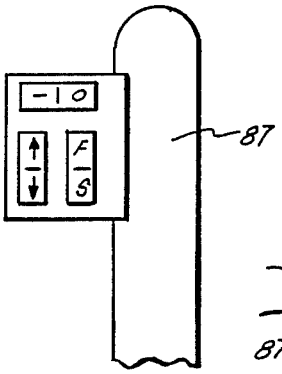
FIG. 15 is a fragmentary view of the embodiment of FIG. 13.
Figure 16:
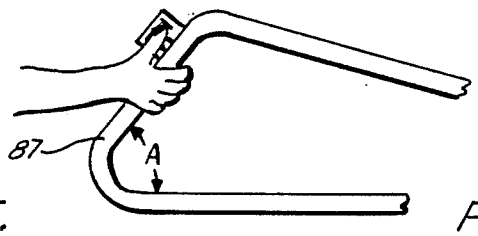
FIG. 16 is a fragmentary elevational view of the embodiment of FIG. 13.

Because of the spacing of handles 81, 82, as shown in FIG. 14, a runner, walker, or jogger can occupy a position between handles 81, 82 while gripping the handles 87. Because the handles rotate upon rotary bearings 83, 84, into multiple positions, as shown in FIG. 13, the handles can be raised or lowered to accommodate persons of various heights. Further, the lowermost position of the handles, as shown in FIG. 1, can be used for shipping purposes. Detent locking can be provided to fix handles 81, 82 in any particular desired elevational position. Display 93 can be pivotally mounted (between 0° and 90° with respect to horizontal) upon cross bar 94, as shown by the curved arrow 95 in FIG. 13, so that the graphics display can be rotated to a comfortable viewing position for any particular user. The bearings 83, 84 can be accompanied by a spring counterbalance so that lifting the handles 81, 82 is easy, even for children. The handles would typically be spaced thirty to thirty-five inches (30"–35") apart.

In view of the numerous modifications which could be made to the preferred embodiments disclosed herein without departing from the scope or spirit of the present invention, the details herein are to be interpreted as illustrative and not in a limiting sense.

What is claimed as invention is:

1. A treadmill with a moving trampoline-like belt surface having a longitudinal axis defined by the direction of movement of the belt during use, comprising:

(a) a frame;

(b) an endless belt having generally parallel lateral edges and mounted for travel on the frame, the uppermost of which is adapted to form a flat exercising surface;

(c) the frame providing a lateral edge support rail spaced from and extending substantially along each lateral side of the endless belt;

(d) connecting means for connecting the lateral edges of the endless belt to the lateral edge support rails to support the lateral edges along the exercising surface as the endless belt moves relative to the frame;

(e) the connecting means including a plurality of brackets mounted for movement along the lateral edge support rails and tensile means for applying tension between the brackets and the lateral edges of the belt at multiple positions along the belt and at acute angles with respect to the lateral edges so that the tensile means tension the belt at its lateral edge portions with both longitudinal and lateral load components;

wherein each bracket includes a plurality of rollers including at least one roller adapted to engage the outer surface of the rail on the side opposite the belt, and further comprising at least one second roller carried by the bracket and positioned generally between the rail and the mat for maintaining a generally semicircular curvature of the belt at the end portions of the belt, and further comprising a curved rail section having a surface which defines at least the curvature at the end of the belt and which is adapted to receive the second roller carried by the brackets, so that the second roller engages the curved rail section at the end portions of the belt.

2. A treadmill with a moving trampoline-like belt surface having a longitudinal defined by the direction of movement of the belt during use, comprising:

(a) a frame;

(b) an endless belt having generally parallel lateral edges and mounted for travel on the frame, the uppermost surface of which is adapted to form a flat exercising surface;

(c) the frame providing lateral edge support means spaced from and extending substantially along both lateral sides of the endless belt;

(d) connecting means for connecting the lateral edges of the endless belt to the lateral edge support means to support the lateral edges along the exercising surface as the endless belt moves relative to the frame;

(e) the connecting means including spring means for applying tension to the lateral edges of the belt;

said spring means comprising shock absorber means defining a shock absorbing connection between the frame and the lateral edge support means for allowing the deflection of each upper edge portion of the belt inwardly during use.

* * * * *